US008064607B2

(12) United States Patent
Monceaux et al.

(10) Patent No.: US 8,064,607 B2
(45) Date of Patent: Nov. 22, 2011

(54) METHOD FOR PRODUCING MORE THAN TWO ELECTRIC TIME SIGNALS FROM ONE FIRST AND ONE SECOND ELECTRIC TIME SIGNAL

(75) Inventors: Jerome Monceaux, Paris (FR); Frederic Amadu, Chelles (FR); Yann Lecoeur, Colombes (FR)

(73) Assignee: Arkamys, Paris (FR)

( * ) Notice: Subject to any disclaimer, the term of this patent is extended or adjusted under 35 U.S.C. 154(b) by 1029 days.

(21) Appl. No.: 11/945,889

(22) Filed: Nov. 27, 2007

(65) Prior Publication Data

US 2008/0152153 A1 Jun. 26, 2008

Related U.S. Application Data

(63) Continuation of application No. PCT/FR2006/001244, filed on May 26, 2006.

(30) Foreign Application Priority Data

May 27, 2005 (FR) ..... 05 51399

(51) Int. Cl.
*H04R 5/00* (2006.01)

(52) U.S. Cl. ..... 381/17; 381/18

(58) Field of Classification Search ..... 381/300, 381/17, 18, 19, 58, 61, 63
See application file for complete search history.

(56) References Cited

U.S. PATENT DOCUMENTS

| | | | | |
|---|---|---|---|---|
| 4,837,825 | A * | 6/1989 | Shivers | 381/307 |
| 4,968,154 | A * | 11/1990 | Baeg | 381/18 |
| 2006/0269069 | A1* | 11/2006 | Polk et al. | 381/17 |
| 2010/0054484 | A1* | 3/2010 | Fincham | 381/17 |
| 2011/0051936 | A1* | 3/2011 | Nakano | 381/17 |
| 2011/0103590 | A1* | 5/2011 | Christoph et al. | 381/17 |
| 2011/0116641 | A1* | 5/2011 | Bergere | 381/17 |

* cited by examiner

*Primary Examiner* — Walter L Lindsay, Jr.
(74) *Attorney, Agent, or Firm* — Perman & Green, LLP

(57) ABSTRACT

A method of producing more than two different electric time sound signals (C(t), GF(t), DF(t), GA(t), DA(t)) from two initial electric time signals (GI(t), DI(t)). The method includes in the frequency domain, producing a central electric frequency sound signal (C(ν)) from the in-phase frequency components of the initial signals; and producing two front signals (GF(t), DF(t)) by subtracting the central signal (C(t)) from the initial signals (GI(t), DI(t)) In addition, two rear signals (GA(t), DA(t)) can be produced from the out-of-phase frequency components of the initial signals. In this way, the method can be used to transform a stereophonic signal into a type 5.1 signal having five different sound signals.

16 Claims, 4 Drawing Sheets

Fig. 3a
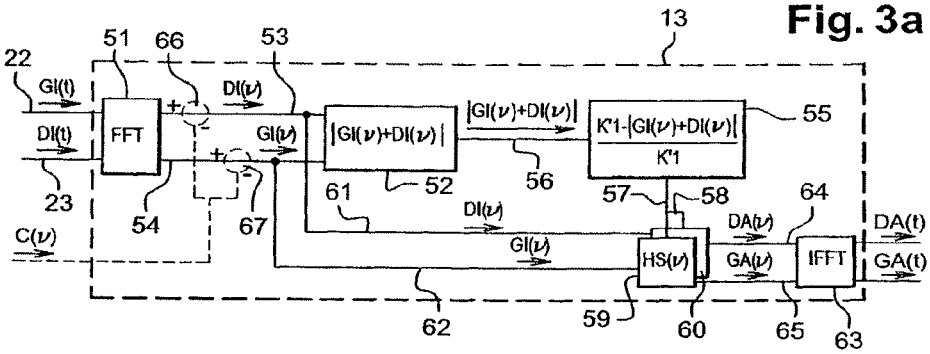
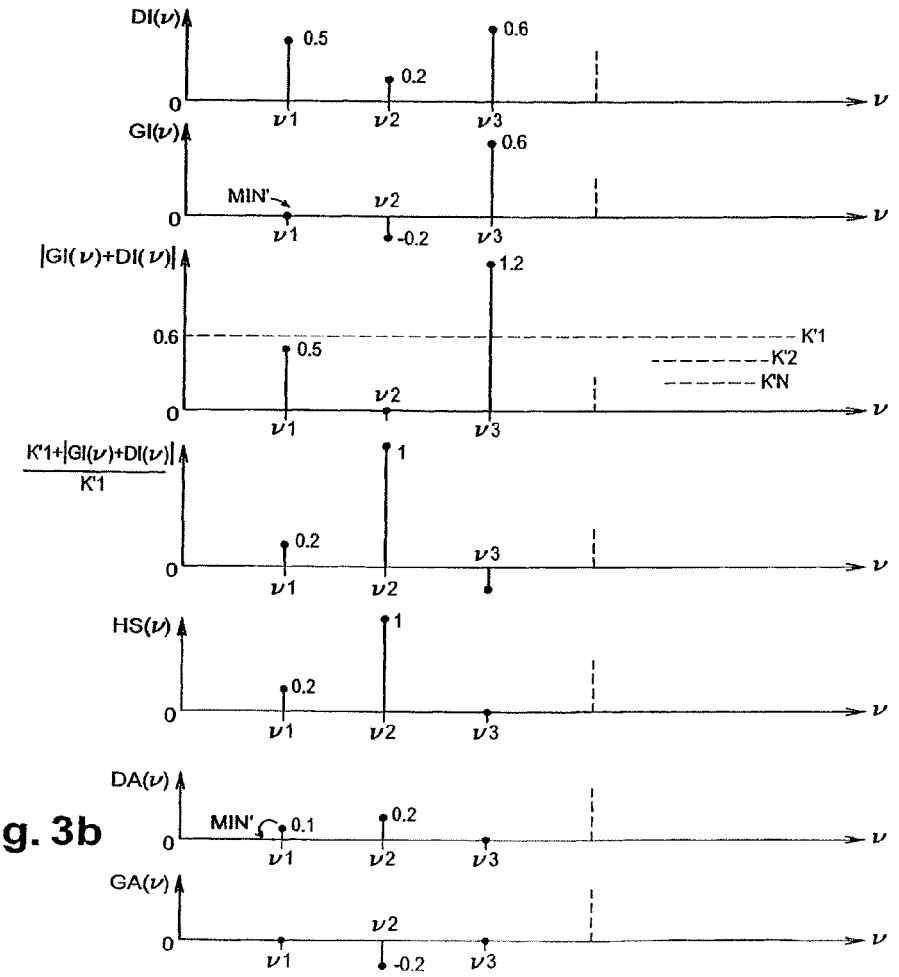
Fig. 3b

METHOD FOR PRODUCING MORE THAN TWO ELECTRIC TIME SIGNALS FROM ONE FIRST AND ONE SECOND ELECTRIC TIME SIGNAL

CROSS REFERENCE TO RELATED APPLICATION

This application is a continuation of International Application No. PCT/FR2006/001244, filed on 26 May 2006, published as WO 2006/125931A1 and claims priority to French application no. 0551399 filed on 27 May 2005.

BACKGROUND

1) Field

The invention essentially relates to a method of producing more than two different electric time signals from one first and one second electric time signal. The invention has a particularly advantageous application in the field of sound processing, to transform a stereophonic sound signal and a multi-band sound signal such as, for example, the system referred to as 5.1 which is broadcast using at least five speakers. In an audio phonic system which is broadcasting a 5.1 signal, each speaker is designed to broadcast a sound signal which is different from the other signals being broadcast.

2) Description of Related Developments

In practice, 5.1 signals are generally broadcast by audio phonic systems that are inside a cinema, an apartment or a car. Such systems provide for a listener, situated in the centre of the space which is delimited by the 5 loud-speakers, the sensation of being surrounded by a rich sound which is coming from five different sources. The simultaneous broadcasting of five or six different sound signals, by the same number of independent speakers, conveys a certain surrounding quality to the sound signal.

Alternatively, with a classic stereophonic system, the listener does not have this sensation of being surrounded and of depth of sound. In reality, the listener only has the impression that the sound coming from the loud speakers is being disseminated, since the number of signals and sound sources is generally limited to two in a stereophonic system.

One of the goals for some of the existing methods is therefore to transform stereophonic sound signals into 5.1 sound signals in order to achieve the best possible listening comfort. A 5.1 signal is broadcast by a system comprising at least five speakers: a central speaker, two (left and right) speakers and two rear (left and right) speakers. A sixth speaker can be added to this system in order to handle low frequencies.

In a first approach, to obtain a 5.1 signal from a stereophonic signal, it would be possible to duplicate the two stereophonic signals on the five speakers. However, duplication such as this would not provide the sensation of being surrounded which is sought by a listener. In reality, even if the number of sound sources are multiplied, the number of different signals being broadcast are not, therefore, this richness of sound is not achieved.

In other known methods, the monophonic components of the stereophonic components contained inside the sound signals of a stereophonic system are separated and broadcast using five speakers.

More exactly, in these methods, the monophonic components of the original stereophonic sound signals are detected and the corresponding signal is broadcast using the central speaker. In addition, to produce front sound signals, the monophonic component of the original sound signals is subtracted and the obtained sound signals are broadcast using front speakers. To produce rear sound signals, the components in phase opposition of the original sound signals are detected and the obtained sound signals are broadcast using rear speakers. The phase opposition sound signals give the impression that the sound being broadcast is coming from behind, or that it is further away from the listening point than the other sounds. One of the aims of these methods is therefore to establish good sound discrimination between different sound signals in order that each speaker broadcasts its own particular sound.

To produce these five sound signals, a method is known in which a filter is applied on the stereophonic and electric time sound signals. However, this time processing involves the use of compressors which possess relatively long response times. These long response times cause pumping, that is to say a sharp variation in intensity, in particular on the left and right channels when the central monophonic signal goes from a high level of sound to a low one. The left and right front sound signals include the monophonic component which is greatly reduced when it is loud in the centre and which becomes foremost when reduced in the centre. However, there is a certain inertia between reduction and increase of the monophonic component. This inertia gives the impression of soundlessness at certain times.

Moreover, this process does not make it possible to obtain good rear stereophony. To obtain rear signals, a same electrical sound signal is broadcast on both the rear speakers. The rear signals thus include stereophonic signal components in phase opposition, but which are mutually monophonic.

A method is also known in which one sound signal is more clearly disassociated from another. To this effect, one of the steps of this method is to remove some of the obtained signal components which are below a threshold. This step permits the reduction of a measured discordance between two adjacent speakers. This discordance characterises the separation between two adjacent speakers. However, the pumping effect is still present.

Another method is known for processing sound in which a filter envelope is capable of changing over a period of time. However, this method has a degree of instability. Over a period of time, the sound sources situated around the listener appear to move. With such a method, it is not possible to obtain the same sound effect throughout the duration of the broadcast. This method does not therefore provide a very enjoyable sensation of sound variation for the listener and does not respect the sound effect desired by the creator of the original sound track.

A method is also known in which a strong reverberation is applied to the stereophonic sound signals. This reverberation corresponds with echoes which increase in density. The method therefore provides a sort of virtual surround effect but cannot give the same richness supplied when broadcasting five different sound signals around the listener. All the sound signals have a commonly held modification information. In this method, there is no real discrimination between the information of five sound signals, rather the tonality of musical pieces is adjusted. As a result, the nature of the originally broadcast work is again being altered.

The invention is proposing, in particular, to provide an improvement in the discrimination between different sound signals, at the same time as resolving these problems relating to pumping and to respect for the original work.

SUMMARY

The explanations which are to follow are given for sound signals. The theory of the invention is however applicable in other fields, in particular to the transport of any type of electrical signal.

To this effect, in the invention, the processing of stereophonic sound signals is mostly carried out in the frequency domain. In the invention, stereophonic electric time signals are transformed into stereophonic electric frequency signals. Then, the in-phase and the out-of-phase frequencies are identified in order to be broadcast respectively on the central speaker and the rear speakers.

More precisely, in the invention, to identify the in-phase components, a monophonic filter with coefficients particularly derived from the difference in the stereophonic electric frequency signals is created, and is applied to the totality of the frequency components of the stereophonic electric signals.

These in-phase frequency components are, in addition, subtracted from the frequency components of the stereophonic sound electric signals in order to obtain the left and right front sound signals.

To obtain the out-of-phase components, a stereophonic filter is created with coefficients particularly derived from the sum of frequency components of both the stereophonic electric signals, and is applied to each of the frequency components of the stereophonic electric signals.

The use of frequency signals makes it possible to obtain an excellent rejection of the monophonic component and thus avoid the effects of pumping, since it is no longer necessary to modulate the right and left signal levels in order to cover the residual monophonic component. Moreover, the processing is very fast, and even if it needs to be differentiated or delayed, the delay is simultaneously applied on the signals.

There is therefore no impression of sound intensity variation. In addition, in the invention, it is only sought to discriminate between the different stereophonic signal components, without changing the sound signals through the introduction, for example, of a reverberation type virtual acoustic effect. The work itself is therefore unchanged during its broadcast; which remains as its creator had intended.

In addition, the stereophonic reconstruction from the five electric sound signals generated by the invention is perfect, that is to say it is exactly the original signal, which is not the case with other known methods.

In variation, it is possible to apply a low-pass filter and a high-pass filter to the central electric sound signal. It is thus possible to create a new base sound source which further enriches the sound area of the listener.

In addition, the filter according to the invention which permits the extraction of in-phase components can be used for transporting original N signals by means of two transport signals. By combining the original N signals with each transport signal, after having modulated or delayed each one in a particular way, it is possible to regain the original N signals by applying modulations or delays to the transport signals which are the inverse of those which were initially applied, and by applying a monophonic filter on the transport signals which have thus been put back in-phase.

The invention relates therefore to a method of producing more than two different electric time sound signals from an initial right electric time sound signal and an initial left electric time sound signal, characterised in that:

in the frequency domain, a central electric frequency sound signal is produced comprising frequency components from in-phase frequency components, particularly present in the neighbouring proportions in the right and left electric time sound signals, and The central electric frequency sound signal and a central electric time sound signal are converted, a front left electric time sound signal is produced by subtraction from the central electric time sound signal of the initial left electric time sound signal, a front right electric time sound signal is produced by subtraction from the central electric time sound signal of the initial right electric time sound signal, Of course, in the end, the electric signals being produced are acoustically broadcast. However, after this production and before this broadcasting, they can be subjected to additional modifications.

In a domain connected to that of leisure type broadcasting here-above referred to, the invention can contribute to an improvement in intelligibility of messages in the domain of hearing devices. In a particular example, two (left and right) initial time signals are used and the above-mentioned transformation is applied; and all or some of the produced signals are recombined so that only two time signals are broadcast and heard through the device earpieces. The initial electric signals are either signals that are measured by the microphones situated in each of the devices, or two signals measured by two microphones situated in a single device. In this way the left and right sound designation essentially identifies the fact that the initial sounds are different (independently from their original placement). In this case, the invention can be used to create a depth of sound in the ears of users. This depth increases the intelligibility of transmitted messages.

In addition, the invention relates to a method of transmitting original and independent electric N signals using two electric transport signals characterised in that, for each of the original N signals, each of these signals is modulated by a first phase modulation, by a first amplitude modulation and a first delay is applied, these first modulations and this first delay being defined by the first parameters, and a first modulated signal is obtained.

Each of these signals is modulated by a second phase modulation, by a second amplitude modulation, and a second delay is applied, these second modulations and this second delay being defined by the second parameters, and a second modulated signal is obtained, the first modulated signals of each of the original independent electric N signals are combined, and the second modulated signals of each of the original independent electric N signals are combined and the first and second transport signals are respectively obtained.

DESCRIPTION OF THE DRAWINGS

The invention will be more easily understood when reading the following description and studying the accompanying drawings. These figures are given as an explanation of and are not limitative to the invention. These figures show:

FIG. 3*a*: a schematic representation of a unit applied to the stereophonic sound signals producing the rear signals comprising the phase opposition components of these signals;

FIG. 3*b*: representations of frequency components of the visible signals at different points of the unit in FIG. 3*a;*

DETAILED DESCRIPTION OF THE PREFERRED EMBODIMENT(S)

Figure 1:
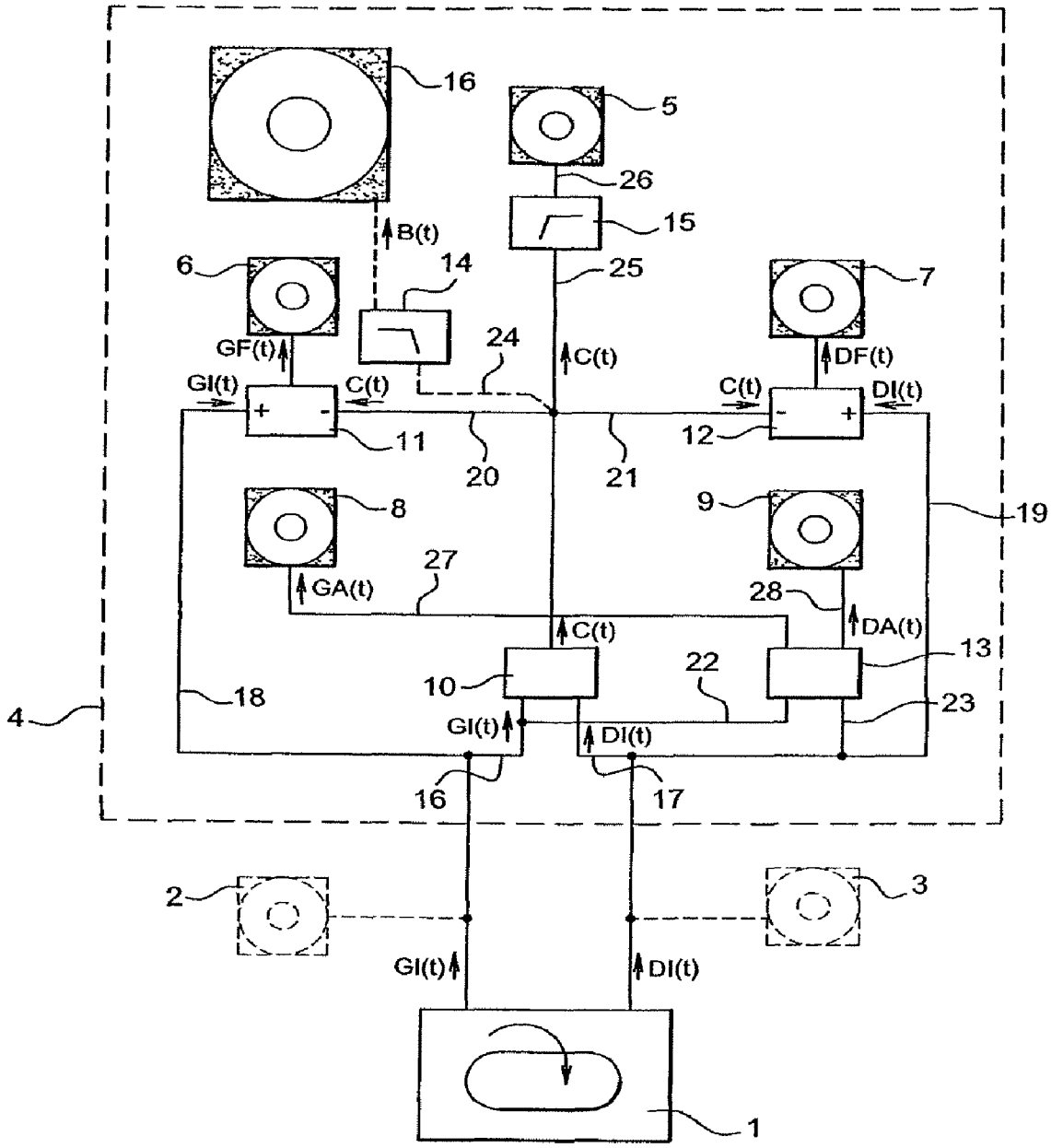
FIG. 1: a schematic representation of a system with at least five speakers carrying out the method according to the invention.

FIG. 1 shows an stereophonic apparatus 1 which emits an initial left electric time sound signal GI(t) and an initial right electric time sound signal DI(t). This stereophonic system 1 can, for example be either a portable or fixed CD or MP3 file player, a television, a portable computer or a mobile phone. In the following part of the document, a signal expressed in the time domain is designated by S(t) and a signal expressed in the frequency domain by S(ν).

In a classic case, the initial electric GI(t) and DI(t) signals will be applied respectively on the inputs of speakers 2 and 3 to be broadcast. However, here, these signals are applied on the terminals of a system 4 to be transformed into at least 5 different 5.1 electric signals: a central electric sound C(t) signal, a front left electric sound GF(t) signal, a front right electric sound DF(t) signal, a back left electric sound GA(t) signal and a back right electric sound DA(t) signal, respectively broadcast by speakers 5-9.

To obtain the central electric sound C(t) signal, the initial left electric sound GI(t) signal and the initial right electric sound DI(t) signal are applied to the terminals of a unit 10, respectively by the use of a connection 16 and a connection 17 linking the outputs of the apparatus 1 and the inputs of the unit 10. This unit 10 produces, in the frequency domain, the central electric frequency sound C(ν) signal, from the in-phase frequency components of the initial right and left electric sound GI(ν) and DI(ν) signals. This unit then transforms the C(ν) signal into a C(t) signal visible on its output. This C(t) signal is applied on a speaker 5 entry for broadcasting.

To produce the front left and right electric time sound GF(t) and DF(t) signals, the initial left electric sound GI(t) signal and the initial right electric sound DI(t) signal are applied respectively to a terminal of a subtracter 11 and 12, through connections 18 and 19 linking the outputs of the apparatus 1 and the inputs of the subtracters 11 and 12. The central electric sound C(t) signal is applied on a terminal of this subtracter 11 and this subtracter 12, via two connections 20 and 21 linking the output of the unit 10 to the subtracting inputs of subtracters 11 and 12.

The unit 11 thus produces a front left electric time sound GF(t) signal by subtraction of the central electric time C(t) sound signal from the initial left electric time sound GI(t) signal. And the unit 12 produces a front right electric time sound DF(t) signal by subtraction of the central electric time sound C(t) signal from the initial right electric time sound DI(t) signal. These GI(t) and DI(t) signals are applied respectively on the in-puts of speakers 6 and 7 to be broadcast.

To produce the back left electric sound GA(t) signal and the back right electric sound DA(t) signal, the initial left and right electric sound GI(t) and DI(t) signals are applied on the terminals of a unit 13, through connections 22 and 23 linking the outputs of the apparatus 1 to the inputs of the unit 13. This unit 13 transforms these GI(t) and DI(t) signals into frequency GI(ν) and DI(ν) signals and produces, in the frequency domain, the back left electric frequency sound GA(ν) signal and the back right electric frequency sound DA(ν) signal, respectively from the GI(ν) and DI(ν) signals. The GA(ν) and DA(ν) signals essentially comprise the frequency components with out-of-phase frequency values. These out-of-phase frequency values are the values for which the frequency components of the initial left electric sound GI(ν) signal present a significant phase difference compared to those of the initial right electric sound DI(ν) signal.

The unit 13 then transforms the GA(ν) and DA(ν) signals obtained into GA(t) and DA(t) time signals. These GA(t) and DA(t) time signals are applied to the inputs of speakers 8 and 9, via connections 27 and 28 respectively linking an output of the unit 13 to an input of the speakers 8 and 9.

In variation, it is possible to also produce a base B(t) signal by applying a low-pass filter 14 to the central electric time C(t) signal being input, through a connection 24 linking the output of the unit 10 and the input of the filter 14. This B(t) signal can be applied on an input of a base speaker 16 to be broadcast. The high frequency part of the central electric C(t) signal is filtered using a high-pass filter 15. The visible signal at the output of this filter 15 is therefore applied at the input of speaker 5, through a 26 connection linking the output of filter 15 to the input of speaker 5.

In variation, in the method according to the invention, only certain C(t), GF(t), DF(t), GA(t) and DA(t) signals are produced, and then combined by subtraction, addition or convolution before being broadcasting. In practice, it can be useful to only broadcast some of these signals in order to create, for example, special sound effects.

Figure 2A:
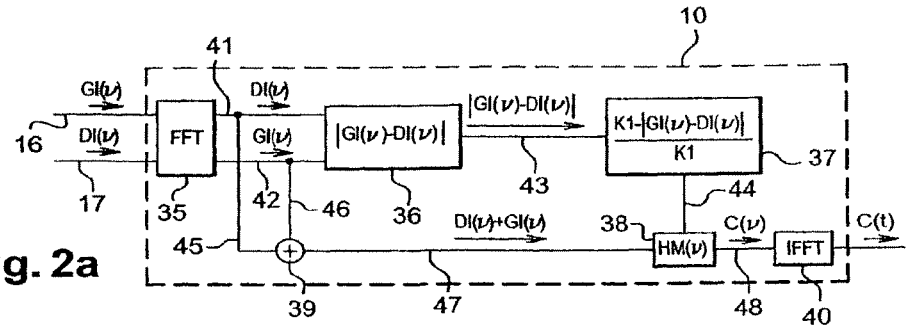
FIG. 2*a*: a schematic representation of a unit applied to the stereophonic sound signals producing the central electric sound signal comprising the in-phase components of these signals.

FIG. 2*a* shows a detailed schematic representation of the unit 10 in FIG. 1 which makes it possible to obtain the central electric sound C(t) signal from the left and right electric sound GI(t) and DI(t) signals.

Figure 2B:
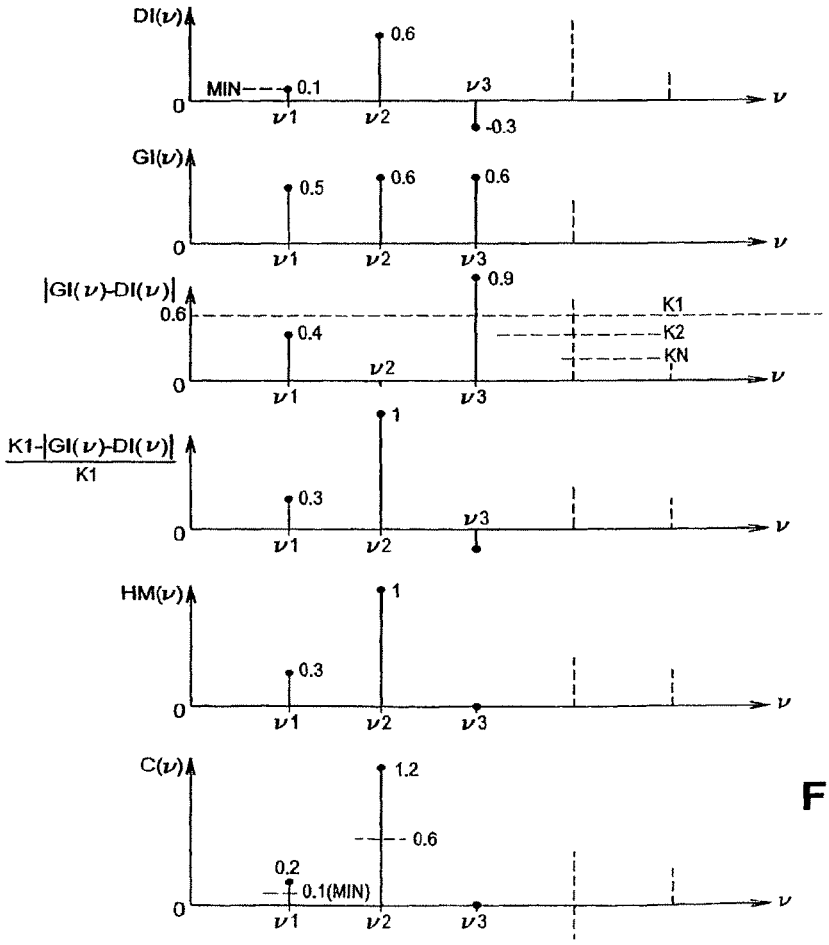
FIG. 2*b*: representations of frequency components of the visible signals at different points of the unit in FIG. 2*a;*

More precisely, the initial GI(t) and DI(t) signals are applied to the input of a Fourier transformer unit 35 through connections 16 and 17. This Fourier transformer unit 35 transforms the GI(t) and DI(t) time signals respectively into DI(ν) and GI(ν) frequency signals. FIG. 2*b* shows the three first frequency components ν1, ν2, ν3 of the DI(ν) and GI(ν) signals. The first, second and third components of the DI(ν) signal possess respectively an amplitude of 0.1; 0.6 and −0.3. The first, second and third components of the GI(ν) signal posses respectively an amplitude of 0.5; 0.6 and 0.6.

The DI(ν) and GI(ν) signals are applied at the input of a unit 36 through connections 41 and 42 linking the outputs of the unit 35 to the inputs of the unit 36. This unit 36 subtracts, component by component, the frequency components of the initial right electric sound DI(ν) signal from those of the initial left electric sound GI(ν) signal to obtain the differential frequency components. The unit 36 then calculates a frequency differential module for each differential component. The |GI(ν)−DI(ν)| signal is thus obtained at the output of the unit 36.

FIG. 2*b* shows this |GI(ν)−DI(ν)| signal. It is therefore possible to see, for the in-phase components of the DI(ν) and GI(ν) signals, such as the second ν2 components, the |GI(ν)−DI(ν)| signal is nil. And for the components of the DI(ν) and GI(ν) signals which are out-of-phase, such as the third components ν3, the |GI(ν)−DI(ν)| signal possesses relatively large values. For the components ν1 of GI(ν) and DI(ν), a component ν1 of the |GI(ν)−DI(ν)| signal is obtained with a value of 0.4.

The |GI(ν)−DI(ν)| signal is applied at the input of a unit 37 through connection 43 linking the output of the unit 36 to the input of the unit 37. This unit 37 subtracts each frequency differential module with a K1 threshold value to obtain the differential frequency residues. In variation, it is possible to define several K1-KN thresholds which can be attributed to different frequency bands. The creation of a K1 threshold permits, as can be seen, the setting of a tolerance during the subtraction of the C(ν) signal. The greater the threshold, the greater the tolerance of components which are not exclusively monophonic. The lower the threshold, the lower the tolerance of components which are not exclusively monophonic.

The unit 37 then standardises the frequency residues by dividing them by the value of the K1 threshold. Thus, on FIG. 2*b*, a value of 0.3 is obtained for the first standardised residue, a value of 1 for the second standardised residue and a negative value for the third standardised residue which is higher than the threshold value. The standardised residues associated with the in-phase components of the DI(ν) and GI(ν) signals therefore possess the value of 1 whereas the standardised residues associated with the out-of-phase components of the DI(ν) and GI(ν) signals have a value inferior to 1.

The values of these residues are then used as parameters for producing a monophonic filter 38 called HM(ν). The electric signal corresponding to the standardised residues is applied on an input of filter 38 through a connection 44 linking the output of the unit 37 to the input of the unit 38.

For the construction of this HM(ν) filter, if a frequency module is superior to the K1 threshold value, the value 0 is applied to the frequency component in question. In the opposite case, the frequency component in question is retained. Thus, the coefficient of the HM(ν) filter corresponding to the third frequency components 3ν of the GI(ν) and DI(ν) signals possess a nil value. Whereas the coefficients of the filter corresponding to the frequency components ν1 and ν2 of the GI(ν) and DI(ν) signals are unchanged.

The HM(ν) monophonic filter is then applied on a sum total, component by component, of the frequency components of the initial right electric sound DI(ν) signal and to those of the initial left electric sound GI(ν) signal. To this effect, the DI(ν) and GI(ν) signals are applied on the inputs of a summing element 39 through connections 45 and 46 linking the outputs of the unit 35 to an input of the summing element 39. The visible signal at the summing element 39 output is applied at the input of the unit 38, through a connection 47 linking an output of the summing element 39 to an input of the filter 38.

Therefore at the filter 38 output, there is a visible HM(ν)*(GI(ν)+DI(ν)) signal corresponding to the central electric frequency sound C(ν) signal. On FIG. 2*b*, the frequency C(ν) signal thus comprises a nil third ν3 component, a second ν2 component with a value of 1.2 and a first νi component with a value of 0.2. This C(ν) signal is principally comprised of the in-phase components of the GI(ν) and DI(ν) signals.

The C(ν) signal is therefore applied on the input of a Fourier inverse transformer unit 40, through a connection 48 linking the output of filter 38 to the input of the unit 40. This unit 40 thus produces the central electric time sound C(t) signal. This C(t) signal can therefore be applied on a speaker 5 input for broadcasting.

It has been shown that in order to obtain the front left and right electric time sound GF(t) and DF(t) signals, the central time sound C(t) signal is subtracted from the GI(t) and DI(t) signals. However, it can seen that here, with a central electric sound C(ν) signal comprising a first component with an amplitude of 0.2, a front right electric sound DF(ν) signal will be obtained comprising a first negative component with a value of −0.1 and a front left electric sound GF(ν) signal comprising a first component with a value of 0.4.

However, in some applications of the method according to the invention, the creation of previously non-existent phase opposition between the front left and right time GF(t) and DF(t) signals is undesirable. To solve this undesirable out-of-phase problem, the minimum MIN between the frequency component of the initial right electric sound DI(ν) signal and the frequency component of the initial left electric sound GI(ν) signal is used. This minimum MIN is then compared with the frequency component produced by the central electric sound C(ν) signal. If the frequency component produced by the central electric sound C(ν) signal is higher than this minimum MIN then this minimum is retained. In the opposite case, the component is retained.

Here, for the first component νi of the C(ν) signal, the value of 0.2 will therefore be replaced by MIN=0.1. A first component of the front right electric sound DF(ν) signal is therefore obtained with a value of 0 and a first component of the left electric sound GF(ν) signal with a value of 0.4. Similarly, the value of the second component of the C(ν) signal is replaced by 0.6 in order to avoid the occurrence of phase difference between the front left and right electric sound signals.

In variation, the frequency residues are used directly as weighting coefficients in the HM(ν) filter.

FIG. 3*a* shows a detailed schematic representation of the unit 13 in FIG. 1 which makes it possible to obtain the rear electric time sound DA(t) and GA(t) signals from the initial electric time GI(t) and DI(t) signals.

In particular, the left and right electric time sound DI(t) and GI(t) signals are applied on two different inputs of a Fourier transformer unit 51, through the connections 22 and 23. An initial left electric frequency sound GI(ν) signal and a right electric frequency sound DI(ν) signal are visible at the output of this unit 51. FIG. 3*b* shows the DI(ν) and GI(ν) signals. The DI(ν) signal comprises three first frequency ν1-ν3 components with respective values of 0.5; 0.2 and 0.6. The GI(ν) signal comprises three first frequency ν1-ν3 components with respective values of 0; −0.2 and 0.6.

The DI(ν) and GI(ν) signals are applied respectively on the input of a unit 52 through two connections 53 and 54 linking the outputs of the unit 51 to the inputs of the unit 52. This unit 52 adds, component by component, the frequency components of the initial right electric sound DI(ν) signal from those of the initial left electric sound GI(ν) signal to obtain the sum frequency components. This unit 52 then calculates a sum frequency module for each sum frequency component. This unit 52 thus makes it possible to identify the out-of-phase components in the initial electric frequency GI(ν) and DI(ν) signals. On FIG. 3*b*, it is also possible to see that the |(GI(ν)+DI(ν)| signal corresponding with the sum module of the GI(ν) and DI(ν) signals gives a nil value for the out-of-phase components, such as the second ν2 components of the GI(ν) and DI(ν) signals, and a high value for the in-phase frequency components of the GI(ν) and DI(ν) signals.

In addition, the electric |GI(ν)+DI(ν)| signal obtained at the output of the unit 52 is applied on the input of the unit 55, through a connection 56 linking the output of the unit 52 to the input of the unit 55. This unit 55 subtracts each frequency module with a K'1 threshold value, in such a way as to obtain the sum frequency residues. Again, it is possible here to have several K'1-K'N thresholds, each K'1-K'N threshold corresponding to a particular frequency band. These K'1-K'N thresholds, when extracting the GA(ν) and DA(ν) signals, convey a certain tolerance by allowing, as will be shown, the preservation of the components which are not completely in phase opposition to each other.

Then, the unit 55 standardises the residues by dividing them by the K'1 threshold value. Thus standardised components are obtained with a value of 1 for the components of the DI(ν) and GI(ν) signals in exact phase opposition, such as the second ν2 components, and the negative standardised components for the in-phase components of the GI(ν) and DI(ν) signals, such as the third ν3 components.

The signal obtained at the output of the unit 55 is applied on the input of the two identical filters 59, 60 called HSG(ν) and HSD(ν), respectively through a first and a second connection 57, 58 linking the output of the unit 55 to an input of filters 59 and 60. Thus, the coefficients of the HS(ν) stereophonic filters can be developed from these standardised residues.

More exactly, in order to create each of these filters 59-60, the components of the standardised signal which are lower than zero are removed. In other words: if a frequency module of the GI(ν) and DI(ν) signal is superior to the K1 threshold value, then the value of zero is applied to the frequency component in question. In the opposite case, the frequency component in question is retained. The first and second HS(ν) coefficients are thus equal to their corresponding standardised residues. The third HS(ν) coefficient corresponding to the in-phase frequency components of the DI(ν) and GI(ν) signals is nil.

In the following step, the stereophonic filters 59 and 60 are applied, component by component, respectively on the frequency components of the initial right electric sound DI(ν) signal and the frequency components of the initial left electric sound GI(ν) signal. Thus, the DI(ν) and GI(ν) signals are respectively applied on the input of filters 59 and 60, through connections 61 and 62 respectively linking an output of the unit 51 and input of the filters 59 and 60.

Thus rear right electric frequency sound DA(ν) and left GA(ν) signals are obtained which principally comprise the out-of-phase frequency components between them. These DA(ν) and GA(ν) signals correspond respectively with the HS(ν)*DI(ν) and HS(ν)*GI(ν) signals.

In an ulterior step, the DA(ν) and GA(ν) signals are applied on an input of a Fourier inverse transformer unit 63, through a connection 64 and 65 linking the output of filters 59 and 60 to an input of the unit 63. The rear right electric sound DA(t) and left GA(t) signals which are transposed into the time domain are thus visible at the output of the unit 63. These DA(t) and GA(t) signals can be applied on the input of speakers to be broadcast.

In a subsidiary step, for each frequency component of the DA(ν) and GA(ν) signals, its value is tested to see if it is above the absolute value of the minimum MIN' in absolute value of the components of the initial DI(ν) and GI(ν) signals. In the case where this component value is superior to the minimum, the value of the component in question is replaced with the minimum. In the opposite case, the component is retained.

In FIG. 3*b*, the value 0.1 of the first ν1 component of the DA(ν) signal is superior to the minimum MIN' of the value of the first component of the DI(ν) and GI(ν) signals which have a zero value. Therefore, the value 0.1 of the first component of the rear right electric sound signal is replaced with the value 0. The other values of ν2 and ν3 components of the GA(ν) and DA(ν) signals are retained. By performing this step, it is thus possible, in the rear electric sound GA(ν) and DA(ν) signals, to retain only the components which are out of phase with each other, In variation, the sum frequency residues are used as weighting coefficients of the frequency components in each HS(ν) stereophonic filter.

In variation, the frequency components of the C(ν) signal are subtracted from the frequency components of the GI(ν) and DI(ν) signals using the subtracters 66 and 67. And the visible signals at the output of these subtracters 66 and 67 are applied on the inputs of the unit 52 and on the inputs of the filters 59 and 69. Such a variation makes it possible to ensure that no in-phase frequency components of the DI(ν) and GI(ν) signals will be present in the rear DA(ν) and GA(ν) signals produced.

In one particular application of a dual speaker broadcasting system, such as a computer, a television or a mobile phone, in order to give a wide sound sensation to the listener, the electric DF(t) and GF(t) signals are produced. A part of GF(t) is subtracted from DF(t), and a part of DF(t) is subtracted from GF(t). The C(t) signal is then added to these new signals. Thus two total time signals are obtained and broadcast using speakers.

Figure 4A:
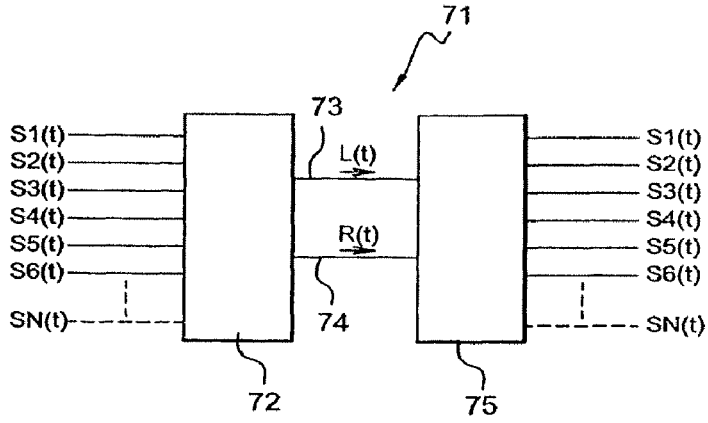
FIG. 4*a*: graphical representations of an encoder decoder system carrying out the method according to the invention for the transmission of electric N signals on two transport signals.

FIG. 4*a* shows a system 71 which performs a method of transmission of original and independent N S1(t)-SN(t) signals through two electric transport L(t) and R(t) signals.

More exactly, the system comprises an encoder 72 in the input terminals on which, the S1(t)-SN(t) signals are applied. This encoder 72 applies different filters on these S1(t)-SN(t) signals and combines them in such a way that they are transformed into two transport L(t) and R(t) signals.

These transport L(t) and R(t) signals are applied to the input of a decoder 75, through the connections 73 and 74 linking between them the outputs of the encoder 72 to the inputs of decoder 75. This decoder 75 applies filters which are the inverse of those applied by the encoder 72 on the L(t) and R(t) signals. The decoder 75 thus subtracts the frequency components of in-phase signals, in such a way as the original N signals S1(t)-SN(t) are visible on their outputs.

Figure 4B:
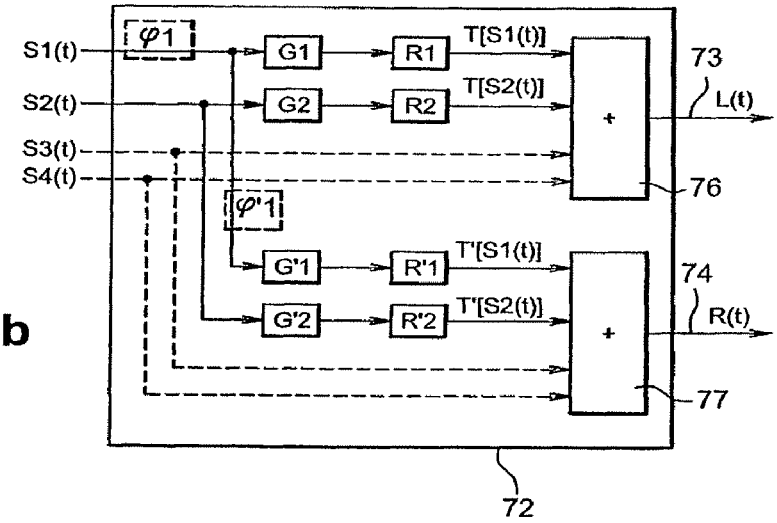
FIG. 4*b*. a schematic representation of an encoder according to the invention permitting the transformation of electric N signals into two electric transport signals.

FIG. 4*b* shows a detailed schematic representation of an encoder 72 according to the invention. Only the four first signals are represented here. The processing applied to the original N signals is similar to that which is applied to the two first S1(t)-S2(t) signals.

The encoder 72 modulates each of the S1(t), S2(t) signals by a first amplitude modulation G1, G2, and applies a first delay R1, R2 on each of these signals. This first modulation and this first delay are defined by the first parameters: G1 and G2 can thus be multiplying coefficients or attenuators of several decibels. Whereas the delays R1, R2 can have a value of some milliseconds. Therefore, a first modulated T[S1(t)], T[S2(t)] signal is obtained and is applied on an input terminal of a summing element 76.

The encoder 72 also modulates each of the S1(t), S2(t) signals by a second amplitude modulation G'1, G'2, and applies a second delay R'1, R'2 on each of these S1(t), S2(t) signals. This second modulation and this second delay are defined by the second parameters: G'1, G'2 can thus be multiplying coefficients or attenuators of several decibels. Whereas the delays R'1, R'2 can have a value of some milliseconds. Therefore, a second modulated T'[S1(t)], T'[S2(t)] signal is obtained and is applied on an input terminal of a second summing element 77.

The first summing element 76 produces the sum of the first modulated T[S1(t)], T[(S2(t)] signals of each of the original independent electric signals A first transport L(t) signal corresponding to this sum is thus visible at its output.

The second summing element 77 produces the sum of the second modulated T[S1(t)], T[(S2(t)] signals of each of the original independent electric signals. A second transport R(t) signal corresponding to this sum is thus visible at its output.

In variation, the original S1(t), S2(t) signals are also modulated by a first phase ϕ1 modulation and a second phase ϕ1 modulation, to obtain respectively the first T[S1(t)], T[(S2(t)] and second T'[S1(t)], T'[(S2(t)] signals.

Thus the first and the second signals are all delayed and modulated in phase and amplitude, the delay can be nil in certain cases, as with the out-of-phase. An applied signal such as this on a summing element input possesses therefore a nil out-of-phase and a modulation of amplitude rapport equal to 1.

Figure 4C:
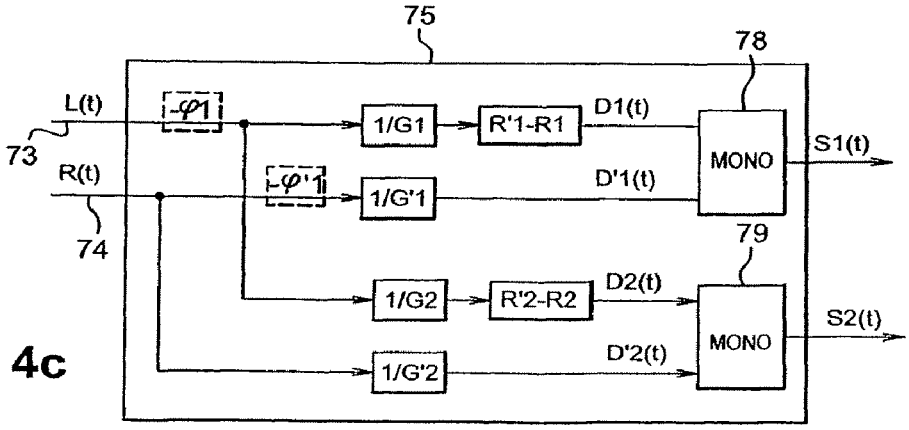
FIG. 4*c*: a schematic representation of a decoder according to the invention permitting the reconstruction of electric N signals from the two electric transport signals emitted by the encoder.

FIG. 4*c* shows a detailed representation of a decoder according to the invention. The first and the second transport L(t), R(t) signal are applied on the decoder 75 inputs, through the connections 73 and 74.

This decoder 75 demodulates the first transport L(t) signal by N (here N=2) first amplitude demodulations I/G1,1/G2, and N first delays are applied to it. These 2N first demodulations and N first delays are defined by 2N first inverse parameters. Each of the 3N first inverse parameters corresponds with the inverse or opposing parameters of the first and second parameters. The amplitude demodulations make it possible to reset the amplitude to that of the original signals whereas the applied delays make it possible to put the original signals back in time and in phase. For the delays, either the inverse delay of each original delay is introduced, or the difference between the two original delays is introduced, as is the case in the figure. Instead of introducing a delay −R1 in the L(t) signal and a delay −R'1 in the R(t) signal, a single delay R'1-R1 in the L(t) signal is introduced. It is the same for the delay R'2-R2. Thus N first demodulated D1(t)-D2(t) signals are obtained.

Similarly, the decoder 75 demodulates the second transport R(t) signal by N second amplitude demodulations 1/G'1, 1/G'2, and apply N second delays. These N second demodulations and N second delays are here again defined by 2N second inverse parameters. These second inverse parameters possess inverse or opposite values to those of the first and second parameters, in order to regain the phase and amplitude of the original signals. Thus N second demodulated D'1(t)-D'2(t) signals are obtained.

Couples of these 2N first D1(t)-D2(t) and second D'1(t)-D'2(t) demodulated signals are selected and combined in the monophonic filters 78-79. In each of these monophonic filters 78-79, an original electric S1(t)-S2(t) signal is constructed from in-phase frequency components of electric transport signals.

To achieve this the first D1(t) and the second D'1(t) demodulated signals are applied on the input terminals of the monophonic filter 78. After demodulation, the D1(t) and D'1(t) demodulated signals comprise frequency components which possess the same amplitude, which are in-phase and which correspond with the frequency components of the original S1(t) signal. By applying the filter 78 which subtracts the in-phase frequency components of signals which have been applied on its input, the S1(t) signal is regained. Similarly, in order to reconstruct the original S2(t) signal, the demodulated D2(t) and D'2(t) signals are applied on the filter 79 input.

In variation, if the phase $\phi 1$, $-\phi'1$ modulations have been operated on the original signals to transport them, N first inverse phase demodulations are introduced on the first transport L(t) signal and N second inverse phase demodulations on the second transport R(t) signal. Thus, to reconstruct the original S1(t) signal, a-$\phi 1$ out-of-phase can be introduced on L(t) and a $\phi'1$ out-of-phase on R(t).

The invention claimed is:

1. A method for producing more than two different electrical time (C(t), GF(t), DF(t)) signals from one first and one second electrical time (GI(t), DI(t)) signal, comprising:

in the frequency domain, a central electric frequency (C(ν)) signal is produced comprising the frequency (ν1-ν3) components from the in-phase frequency components of the first and second electric (DI(ν), GI(ν)) signals, these in-phase components having amplitudes of a difference lower than a (K1-KN) threshold, and a third time (C(t)) signal is produced from this central electric frequency (C(ν)) signal.

2. A method for producing more than two different electric time sound (C(t), GF(t), DF(t), GA(t), DA(t)) signals from an initial left electric time sound (GI(t) signal and an initial right electric time sound (DI(t)) signal, comprising:

in the frequency domain, a central electric frequency (C(ν)) signal is produced comprising the frequency (ν1, ν3) components from the in-phase frequency components of initial left and right electric sound (GI(ν), DI(ν)) signals, these in-phase components having amplitudes of a difference inferior to a (K1-KN) threshold, the central electric frequency sound (C(ν)) signal is converted into a central electric time sound (C(t)) signal, a front left electric time sound (GF(t)) signal is produced by subtraction of the central electric time sound (C(t)) signal from the initial left electric sound (GI(t)) signal, and a front right electric time sound (DF(t)) signal is produced by subtraction of the central electric time sound (C(t)) signal from the initial right electric sound (DI(t)) signal.

3. A method according to claim 2 further comprising:

in the frequency domain, a rear left electric frequency sound (GA(ν)) signal and a rear right electric sound (DA(ν)) signal are produced, respectively from the initial left and right electric sound (GI(ν), DI(ν)) signals, these rear left and right (GA(ν), DA(ν)) signals essentially comprising the (ν1-ν3) out-of-phase frequency components, wherein these out-of-phase components being components for which the frequency components of the initial left electric sound (GI(ν)) signals present a significant phase difference compared to those of the initial right electric sound (DI(ν)) signal.

4. A method according to claim 2, characterised in that, to produce the central electric sound (C(ν)) signal:

an HM(ν) monophonic filter is applied on a sum total, component by component, of the frequency components of the initial left electric sound (GI(ν)) signal and to those of the initial right electric sound DI(ν) signal, and in the monophonic (HM(ν)) filter the frequency components of the initial right electric sound (DI(ν)) signal are subtracted component by component from those of the initial left electric sound (GI(ν)) signal to obtain the differential frequency components, a frequency differential module is calculated for each frequency differential component, each frequency differential module with a (K1) threshold value is subtracted and the differential frequency residues are obtained, and the differential frequency residues are used as weighting coefficients of the frequency components in the (HS(ν)) monophonic filter.

5. A method according to claim 4, wherein to produce the central electric sound (C(ν)) signal, the residues are standardised by dividing them by the (K1) threshold value.

6. A method according to claim 4, wherein to produce the central electric sound (C(ν)) signal, if a frequency module is superior to the (K1) threshold value, then the value zero is applied to the frequency component in question.

7. A method according to claim 4, wherein for a given frequency component of the central electric sound (C(ν)) signal, the minimum (MIN) between the frequency component of the right electric sound (DI(ν)) signal and the frequency component of the left electric sound (GI(ν)) signal is defined, and this minimum is compared with the frequency component produced by the central electric sound (C(ν)) signal, and if the frequency component produced by the central electric sound (C(ν)) signal is higher than this minimum (MIN) then this minimum is retained, and if the frequency component produced by the central electric sound (C(ν)) signal is lower than this minimum (MIN) then this component is retained.

8. A method according to claim 2, wherein to produce the rear right and left electric (GA(ν), DA(ν)) signals, the (HS(ν)) monophonic filters are applied, component by component, respectively on the frequency components of the initial left electric sound (GI(ν)) signal and the frequency components of the initial right electric sound (DI(ν)) signal, and in each monophonic (HS(ν)) filter the frequency components of the initial left electric sound (GI(ν)) signal are added component by component to those of the initial right electric sound (DI(ν)) signal to obtain the sum frequency components, a sum frequency module is calculated for each sum frequency component, each sum frequency module with a (K1) threshold value is subtracted to obtain the sum frequency residues, and the sum frequency residues are used as weighting coefficients of the frequency components in each (HS(ν)) monophonic filter.

9. A method according to claim 8, wherein to produce the rear right and left electric sound (GA(ν), DA(ν)) signals the residues are standardised by dividing them by the (K1) threshold value.

10. A method according to claim 8, wherein to produce the rear left and right electric sound (GA(ν), DA(ν)) signals, if a frequency module is superior to the threshold value, then the value zero is applied to the frequency component in question.

11. A method according to claim 8, wherein for each frequency component of the rear electric sound signals, the value of this component is compared with the minimum frequency component values of the front left and right electric sound signals and, if this value is superior to the minimum, then the component in question is replaced with the minimum.

12. A method according to claim 8, further comprising before applying the (HS(ν)) monophonic filters, the frequency components of the central electric sound (C(ν)) signal are subtracted from the frequency components of the initial left and right electric sound (GI(ν), DI(ν)) signals.

13. A method according to claim 2, wherein a base frequency central electric sound (C(ν)) signal is produced by the application of a low frequency filter (14) on the frequency components of the central electric sound signal.

14. A method according to claim 1, wherein some of more than two time signals produced are combined in order to produce only two combined time signals.

15. A method for transmitting original and independent electric N (S1-SN) signals using two electric transport (L(t), R(t)) signals comprising, for each of the original N signals, each of these (S1(t)-SN(t)) signals is modulated by a first phase (φ1) modulation, by a first (G1, G2) amplitude modulation, and a first (R1, R2) delay is applied, these first modulations and this first delay being defined by the first parameters, and a first modulated (T[S1(t)], T[(S2(t)]) signal is obtained, each of these (S1(t)-SN(t)) signals is modulated by a second phase (φ1) modulation, by a second (G'1, G'2) amplitude modulation, and a second delay is applied, these second modulations and this second delay being defined by the second parameters, and a second modulated (T'[S1(t)], T'[(S2(t)]) signal is obtained, the first modulated (T[S1(t)], T[(S2(t)]) signals of each of the original independent electric N signals are summed, and the second modulated (T'[S1(t)], T'[(S2(t)]) signals are summed of each of the original independent electric N signals and, respectively, the first and the second transport (L(t), R(t)) signals are obtained.

16. A method according to claim 15, further comprising the first and the second transport (L(t), R(t)) signals are received, the first transport (L(t)) signal is demodulated by N first phase (−φ1) demodulations, by N first amplitude demodulations (1/G1, 1/G2), and N first delays are applied to it, these 2N first demodulations and N first delays being defined by 3N first inverse parameters, and N first demodulated signals are obtained, each of the 3N first inverse parameters being the inverse parameters of the first parameters, the second transport signal is demodulated by N second phase (−φ'1) demodulations, by N second amplitude demodulations (1/G'1, 1/G'2), and N second delays are applied to it, these 2N second demodulations and N second delays being defined by 3N second parameters, and N second demodulated signals are obtained, couples of these 2N first and second demodulated signals are selected and combined in the monophonic filters, and in each of the monophonic filters an original electric signal is constructed from in-phase frequency components of electric transport signals.

* * * * *